United States Patent [19]

Murphy

[11] Patent Number: 4,980,672

[45] Date of Patent: Dec. 25, 1990

[54] OVERHEAD SOCKET SMOKE DETECTOR WITH THEFT ALARM

[75] Inventor: D. Patrick Murphy, Grain Valley, Mo.

[73] Assignee: Generation 2, Inc., Overland Park, Kans.

[21] Appl. No.: 422,500

[22] Filed: Oct. 17, 1989

[51] Int. Cl.[5] ..... G08B 13/14

[52] U.S. Cl. ..... 340/571; 315/136; 340/693

[58] Field of Search ..... 340/693, 628-630, 340/584, 571, 568, 506; 315/129, 136

[56] References Cited

U.S. PATENT DOCUMENTS

| | | | |
|---|---|---|---|
| 3,817,161 | 6/1974 | Koplon | 98/39.1 |
| 3,953,844 | 4/1976 | Barr et al. | 340/627 |
| 3,964,036 | 6/1976 | Adachi et al. | 340/514 |
| 4,211,959 | 7/1980 | Deavenport et al. | 315/362 |
| 4,334,172 | 6/1982 | Wyner et al. | 315/289 |
| 4,369,435 | 1/1983 | Adachi et al. | 340/506 |
| 4,630,248 | 12/1986 | Scott | 367/197 |
| 4,694,285 | 9/1987 | Scripps | 340/693 |
| 4,717,910 | 1/1988 | Scripps et al. | 340/693 |
| 4,812,827 | 3/1989 | Scripps | 340/693 |
| 4,823,051 | 4/1989 | Young | 315/155 |
| 4,829,283 | 5/1989 | Spang et al. | 340/506 |

*Primary Examiner*—Glen R. Swann, III
*Assistant Examiner*—Thomas J. Mullen, Jr.
*Attorney, Agent, or Firm*—Litman, McMahon & Brown

[57] ABSTRACT

An overhead socket smoke detector with a theft alarm includes a case with a bulb base at one end and a lamp socket at an opposite end and connected to the bulb base by a socket switch which is closed by a lamp received in the socket to electrically activate the socket. The case has a cylindrical diameter to fit within a can light fixture. Smoke alarm circuitry is mounted within the case and includes a smoke sensor circuit, a trigger circuit, and a sounder circuit. A unit removal or theft switch connected to the trigger circuit includes a switch operator extending through the bulb base to engage a socket into which the case is threaded. A rechargeable battery and a battery charger are connected between the bulb base and the alarm circuitry and provide power to operate the alarm circuitry. When the unit is removed from its fixture, the unit removal switch disengages the fixture socket and triggers the sounder circuit into activation to deter removal of the unit from the socket in which it is mounted.

21 Claims, 2 Drawing Sheets

OVERHEAD SOCKET SMOKE DETECTOR WITH THEFT ALARM

FIELD OF THE INVENTION

The present invention relates to smoke detector devices and, more particularly, to such a device which is powered by a rechargeable battery, which is adapted for threaded reception in an overhead light socket and receiving a lamp bulb therein, and which includes a theft removal switch which triggers the alarm when the unit is removed from the light socket.

BACKGROUND OF THE INVENTION

Fire and smoke detector devices have been developed to alert occupants of rooms and buildings to take emergency action in the earliest stages of a fire. In many localities, ordinances have been enacted requiring the installation of smoke detector devices in all new and existing dwellings. Smoke alarm devices are available as battery powered units and as AC powered units. Permanently wired AC powered units are generally more expensive to purchase and usually require the services of an electrician. Battery powered smoke alarms are inexpensive and easy to install, although their effectiveness can be diminished by improper placement.

Battery powered units usually incorporate circuitry which causes a chirping signal or the like to be emitted when battery power drops below a threshhold level. Some units become unstable and emit false alarms when battery power drops to a level just above the threshhold. As a result, some residents consider smoke alarm devices to be a nuisance and fail to replace exhausted batteries, thus relinquishing the protection afforded by them. Battery powered smoke alarm devices, because of their low installation costs, are often provided in public housing units. A particular problem in such environments is that the units are often stolen.

In general, fire safety experts recommend that smoke alarm devices be placed near the ceiling of a room, and preferably near the center. In somewhat older homes, such a position is usually occupied by an existing light fixture. In newer homes without such ceiling fixtures, there are sometimes aesthetic objections to the placement of conventional smoke alarm devices in the center of a ceiling. In order to fulfill the needs of such circumstances, smoke alarm devices have been developed which incorporate light fixtures therein. Because of their use as light fixtures which will be switched on and off in the normal course of use, such devices are often powered by rechargeable batteries which are charged when the lamp is switched on. Smoke alarm devices with combined light fixtures are provided as hard wired, permanently mounted fixtures. These are suitable for a room with no ceiling fixture or as a replacement for an existing light fixture. However, they require professional installation.

Other types of smoke alarms with light fixtures include an integral threaded bulb base at one end for installation in an existing screw socket and a unit socket at the other end to receive a lamp bulb. A problem with the known devices of this type is that they retain the well known size and shape of conventional battery powered smoke detectors, that is, a flattened cylindrical shape of about six inches or greater in diameter. Devices of this shape are inappropriate for many existing fixtures since the alarm devices do not accommodate the diffusers or shades which form a part of the existing fixture.

Thus, the resident is left with a bare bulb. Additionally, modern residential lighting often includes lamps mounted in so-called can light fixtures and track light fixtures. The dimensions of the broad cylindrical screw-in smoke alarms conventionally available will not fit within such fixtures. A problem with both permanently mounted and screw-in smoke alarms incorporating lamp sockets is that an electrical shock hazard exists in them when no lamp bulb is present in the unit socket.

SUMMARY OF THE INVENTION

The present invention provides a screw-in smoke alarm device with a lamp socket which is deactivated when the lamp bulb is removed and which includes a unit removal switch connected to trigger the alarm if the unit is removed from the socket in which it is installed. The device includes a cylindrical case which is sized to fit within a can light fixture or the like and allow adequate airflow therearound to reliably monitor for the presence of smoke. A threaded bulb base is provided at one end and a unit socket at the opposite end. A socket switch connects the unit socket to the bulb base and is closed to activate the unit socket only if a lamp bulb is threaded into it.

Conventional smoke, or alternatively heat, alarm circuitry is positioned in the case and includes a smoke or heat sensor, a trigger circuit, and a sounder circuit. The circuitry is powered by a rechargeable battery which is maintained by a charger circuit receiving power from the existing socket in which the unit is installed when the existing socket is electrically active. A unit removal, or theft, switch is connected to the trigger circuit and includes a button or switch operator which extends through the bulb base to engage the fixture socket. Once the unit has been installed in the fixture socket and the battery has been charged, removal of the unit from the fixture socket releases the theft switch operator which causes the trigger circuit to activate the sounder circuit and emit an audible alarm. The theft alarm is provided to deter removal of the unit from its fixture socket.

The device of the present invention otherwise operates in the manner of a conventional smoke or heat detector and allows use of the fixture in which it is installed to be operated as a conventional switched light fixture.

OBJECTS OF THE INVENTION

The principal objects of the present invention are: to provide an improved smoke alarm device; to provide such a device which incorporates a light fixture therein; to provide such a device which is sized, shaped, and otherwise suitable for use with existing types of light fixtures with threaded sockets, such as conventional surface mounted fixtures on ceilings, can light fixtures, track light fixtures, and the like; to provide such a device including a threaded bulb base at one end connected to an integral threaded unit socket at the opposite end by a socket switch which allows the unit socket to be activated only if a lamp bulb is placed in the unit socket; to provide such a device including a theft alarm to deter removal of the unit from the socket in which it is installed; to provide such a device including a unit removal switch connected to a trigger circuit within the unit and a switch operator which normally engages the fixture socket in which the unit is installed and which disengages therefrom upon removal of the unit and causes the alarm sounder to emit an alarm sound; to provide such a device including a rechargeable battery for powering the alarm circuitry of the device; to provide such a device including a battery charger within the unit, connected to the bulb base, receiving power therefrom when the socket in which the unit is mounted is activated, and providing charging current to the battery; to provide such a device which is easily installable by a resident in an existing ceiling light fixture; and to provide such an overhead smoke detector with a theft alarm which is economical to manufacture, stable and reliable in operation, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
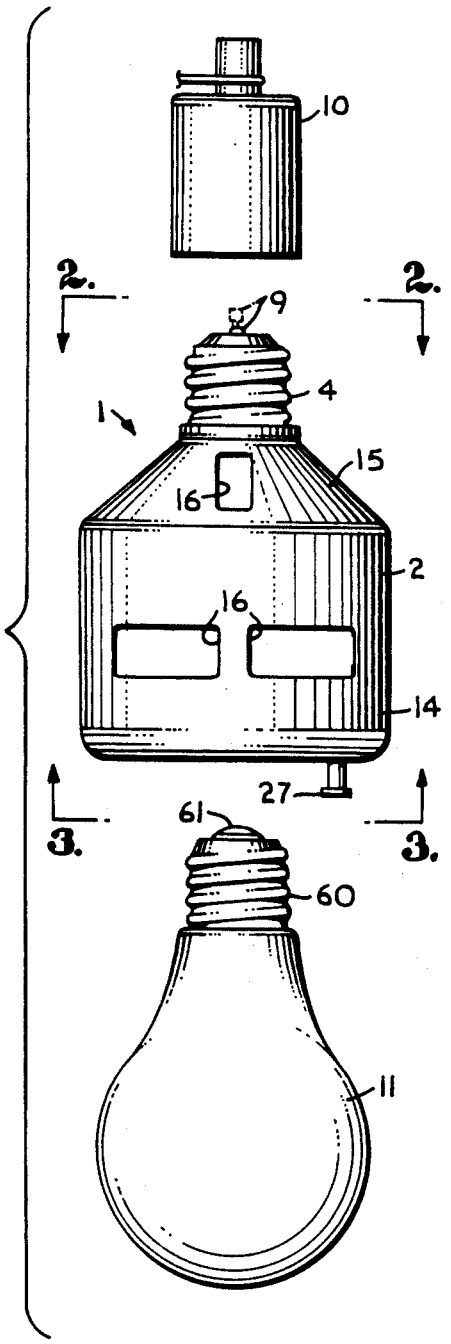
FIG. 1 is an exploded side elevational view of an overhead socket smoke alarm unit with a theft switch embodying the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally designates an overhead socket smoke alarm device with a theft switch which embodies the present invention. The device or unit 1 generally includes a case 2 housing smoke alarm circuitry 3 (FIG. 4) and having a threaded bulb base 4 at a top end and a threaded unit socket 5 at an opposite end. The unit 1 is provided with a unit socket switch 7 connecting the unit socket 5 with the bulb base 4 and a unit removal switch 8 (FIG. 4) including a removal switch operator 9 which extends from the bulb base 4 to engage a fixture socket 10 in which the unit 1 is installed. The unit socket switch 7 is a safety provision which causes the unit socket 5 to be electrically continuous with the bulb base 4 only when a lamp 11 is placed in the unit socket 5. The unit removal or theft switch 8 is connected to the alarm circuitry 3 and causes an alarm sounder 12 (FIG. 4) to be activated when the unit 1 is removed from the fixture socket 10.

Figure 2:
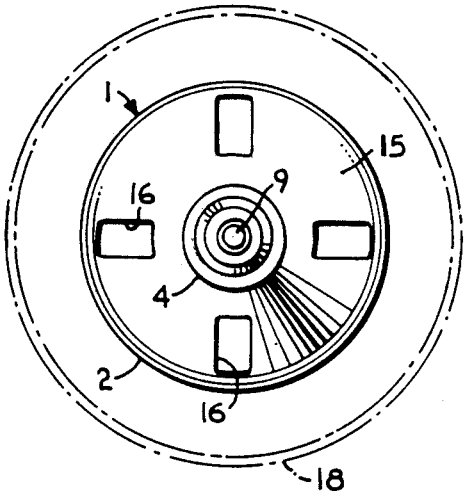
FIG. 2 is a top plan view of the unit taken on line 2—2 of FIG. 1 and illustrates a unit removal switch operator thereof.
Figure 3:
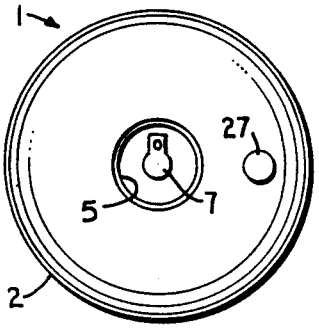
FIG. 3 is a bottom plan view of the unit taken on line 3—3 of FIG. 1 and illustrates a lamp receiving socket and a socket deactivating switch thereof.

Referring to FIGS. 1–3, the case 2 includes a cylindrical portion 14 with a frustoconical portion 15 connecting between the cylindrical portion 14 and the bulb base 4. The portions 14 and 15 are provided with vents or openings 16 to allow the flow of air through the case 2 to allow the circuitry 3 to monitor it for smoke particles. The cylindrical portion 14 is the widest part of the unit 1 and has a diameter which is only slightly greater that the principal axial diameter of the low to medium wattage light bulb 11. Thus, the unit 1 is sized to fit within standard sizes of can light fixtures 18, shown diagrammatically in FIG. 2, and similar types of fixtures, with adequate room around the case 2 to allow the flow of air through the fixture 18.

Figure 4:
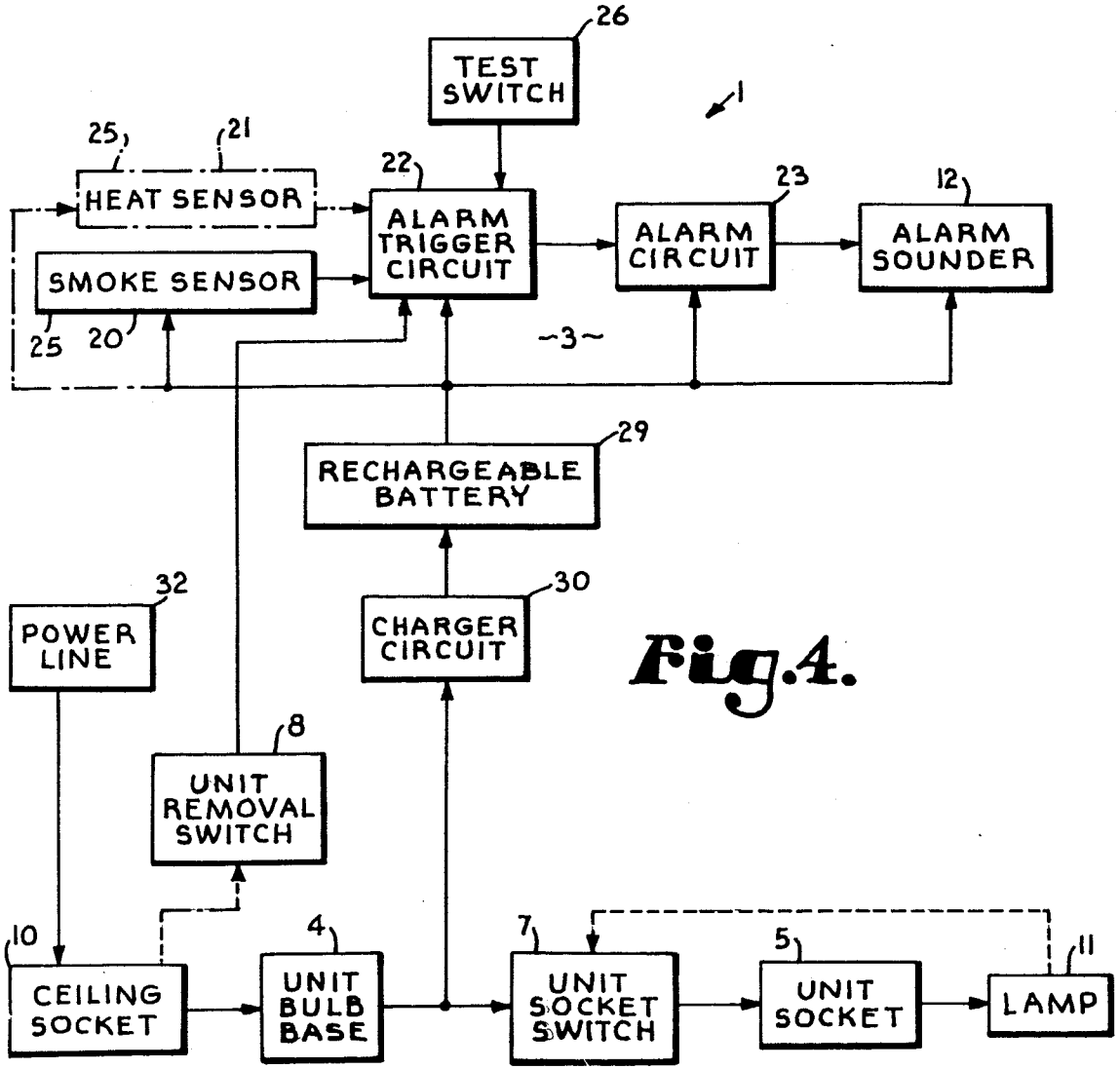
FIG. 4 is a block diagram illustrating the principal components of the smoke alarm circuitry of the unit of the present invention.

Referring to FIG. 4, the unit 1 incorporates conventional types of alarm circuitry 3, which may either be for the detection of smoke or excessive levels of heat. The unit 1 is described herein principally with reference to smoke detection; however, with the exception of the type of sensor used, the circuitry 3 is also suitable for heat detection. The illustrated circuitry 3 includes a smoke sensor 20, with an alternative heat sensor 21 shown in phantom, an alarm trigger circuit 22, an alarm driver circuit 23, and the alarm sounder 12.

The smoke sensor 20 may be a conventional ionization type smoke sensor, a photoelectric type smoke sensor, or the like. The heat sensor 21 may be a thermovoltaic device or may incorporate a thermistor or a temperature dependent transistor of conventional design. The sensors 20 and 21 may be referred to generically as thermal emergency sensors 25 and provide a thermal condition signal proportional in some manner to the smoke particle content or temperature of air flowing through the case 2.

The trigger circuit 22 is a threshhold or comparator type of circuit to which the sensors 25 are connected and which compares the level of the condition signal therefrom with a reference signal. When the condition signal level equals or exceeds the reference signal, the trigger circuit 22 outputs a trigger signal, which may be either analog or digital in form, until the condition signal level drops below the reference level. The alarm driver circuit 23 responds to the trigger signal by activating the sounder 12 to emit an alarm sound signal as long as the trigger signal is present. The sounder 12 may be a solid state type of audible signalling device. Such devices are well known and are capable of emitting a loud, shrill sound which is difficult for most persons to ignore. The unit 1 preferably includes a test switch 26 which is connected to the trigger circuit 22 and which may include a timer (not shown) whereby pressing a test button 27 (FIGS. 1 and 3) causes the trigger circuit 22 to output the trigger signal for a selected length of time to test the alarm sounding operability of the unit 1.

The alarm circuitry 3 of the unit 1 is powered by a rechargeable battery 29, which may be a nickel-cadmium battery or the like. The battery 29 is recharged by a battery charger circuit 30 which, along with the battery 29, is mounted within the case 2. The charger 30 is connected across the conductors of the bulb base 4 and receives power from the fixture socket 10 through the bulb base 4 when the socket 10 is switched to electrical activation by completing a circuit with a power line 32 connected thereto to illuminate the bulb 11.

The unit removal switch 8 is connected to the alarm trigger circuit 22 and functions in a manner similar to the test switch 26 except that the removal switch 8 does not incorporate a timer therein. The switch 8 has a mounted switch state when the removal switch operator 9 is pressed in by installation of the unit 1 in the fixture socket 10. When the operator 9 extends upon removal of the unit 1 from the socket 10, the switch 8 is placed in a removed switch state which causes the trigger circuit 22 to output the trigger signal for as long as the operator 9 remains out or until the battery 29 is exhausted. The trigger signal is accompanied by a sound signal from the sounder 12 and, thus, draws attention whenever the unit 1 is removed from its installation in the fixture socket 10.

Figure 5:
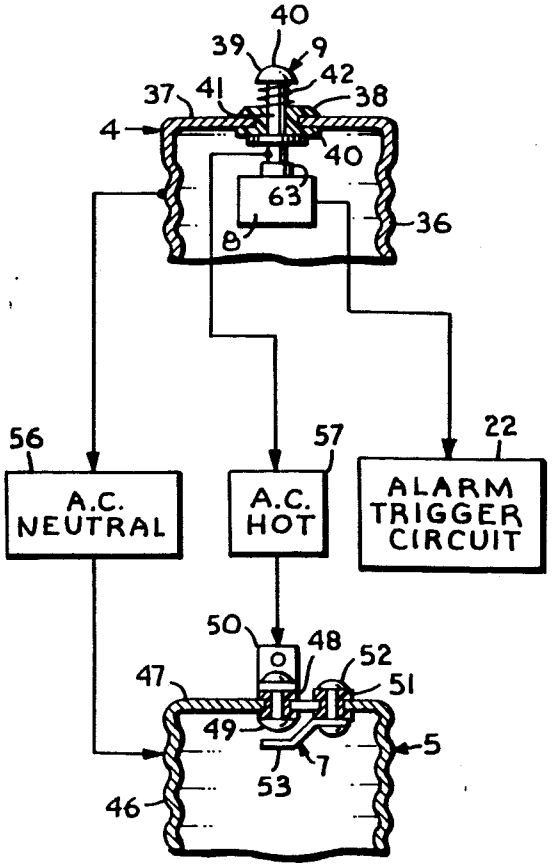
FIG. 5 is a diagrammatic view illustrating details of the unit removal switch and the socket deactivating switch of the unit of the present invention.

FIG. 5 illustrates structural details of the removal switch operator 9 and the unit socket switch 7 and their relationship to the bulb base 4 and the unit socket 5. The bulb base 4 includes a threaded conductive, cylindrical neutral terminal 36 which is closed by an end wall 37. An insulator grommet 38 is positioned centrally through the wall 37 and has the removal switch operator 9 slidably mounted therethrough. The switch operator 9 is formed of a conductive metal and forms a hot terminal 39 of the bulb base 4. The operator 9 has a retainer washer 40 positioned on a shaft 41 thereof to limit sliding movement of the operator 9. A compression spring 42 is positioned between a head 43 of the operator 9 and the grommet 38 and resiliently urges the operator 9 to an extended position.

The unit socket 5 includes a threaded cylindrical, conductive neutral terminal 46 which is closed at one end by an end wall 47. An insulative grommet 48 is mounted centrally through the end wall 47 and has a conductive rivet 49 therein which forms a hot terminal of the unit socket 5. A hot connector lug 50 may also be retained by the rivet 49. A second insulative grommet 51 is mounted through the end wall 47 at a radially outward position therefrom, and a second rivet 52 retains a spring conductive contact 53 within the unit socket 5. The contact 53 extends over a lower end of the rivet 49 and is resiliently urged away therefrom. The center rivet 49 and the spring contact 53 form contacts of the unit socket switch 7 which is a normally open switch.

The neutral terminal 36 of the bulb base 4 is connected to the neutral terminal 46 of the unit socket 5 by a neutral conductor 56. The hot terminal 39 or switch operator 9 of the bulb base 4 is connected to the lug 50 on the rivet 49 of the unit socket 5 by a hot conductor 57. Thus, when the unit 1 is positioned in the fixture socket 10 and it is electrically active, accessible conductors of the unit socket 5 are not electrically active and do not present a shock hazard. The accessible contact 53 is not electrically activated until the bulb base 60 of the lamp bulb 11 is threaded into the unit socket 5 and the hot terminal 61 of the bulb base 60 presses the contact 53 into conductive engagement with the center rivet 49.

The unit removal switch 8 is illustrated in FIG. 5 as a push button switch unit which is mounted within the bulb base 4 and which includes an operator button 63 aligned with the shaft 41 of the operator 9. This allows the unit removal switch 8 to be electrically isolated from the AC power levels carried by the operator 9 which functions as the hot terminal 39 of the bulb base 4. Alternatively, other types of switch units or switch contact arrangements which accomplish the same purpose could be provided in the unit 1. The unit removal switch 8 may be either a normally open switch or a normally closed switch (in its extended position) depending on the logic requirements of the alarm trigger 22 to which it is connected.

The removal switch operator 9 engages a hot terminal (not shown) of the fixture socket 10 when the unit bulb base 4 is threaded thereinto. This places the unit removal switch 8 in its mounted switch state, which causes the trigger circuit 22 to respond only to the sensor 25 or the test switch 26. When the unit bulb base 4 is unthreaded from the fixture socket 10, the operator 9 extends and places the removal switch 8 in its removed switch state which causes the trigger circuit 22 to output its trigger signal to thereby activate the sounder 12.

It is to be understood that while certain forms of the present invention have been illustrated and described herein, it is not to be limited to the specific forms or arrangement of parts described and shown.

What is claimed and desired to be secured by Letters Patent is as follows:

1. An alarm device comprising:

(a) an alarm case including case mounting means adapted to enable mounting said case to a structure;

(b) alarm circuit means positioned in said case, sensing a selected condition, and including alarm signal generator means triggerable to generate an alarm signal upon sensing said condition;

(c) said alarm circuit means including trigger circuit means connected to said generator means and providing a trigger signal to said generator means to cause same to generate said alarm signal upon said alarm circuit means sensing said condition;

(d) case removal switch means positioned in said case and associated with said case mounting means such that said switch means assumes a first switch state when said case means is mounted to said structure and a complementary second switch state when case is not mounted to said structure; and (e) said switch means being connected to said trigger circuit means and causing same to provide said trigger signal upon said switch means assuming said second switch state whereby removal of said case from said structure causes said alarm signal to be generated.

2. A device as set forth in claim 1 wherein said removal switch means includes:

(a) a case removal switch operator mounted in said case and causing said removal switch means to assume said first switch state when said operator engages said structure and said second switch state when said operator is out of engagement with said structure.

3. A device as set forth in claim 1 wherein:

(a) said structure includes structure connector means which is electrically activatable;

(b) said case mounting means includes electrical case connector means which is compatable with said structure connector means whereby said case is mounted to said structure by engaging said case connector means with said structure connector means; and (c) said case connector means has said alarm circuit means connected thereto whereby said alarm circuit means receives power from said structure connector means through said case connector means when said case connector means is engaged with said structure connector means and said structure connector means is electrically activated.

4. A device as set forth in claim 3 wherein:

(a) a threaded case socket is positioned on said case and adapted to receive a lamp bulb therein;

(b) said case socket is connected to said case connector means whereby a lamp bulb received in said case socket receives power from said structure connector means through said case connector means when said case connector means is engaged with said structure connector means and said structure connector means is electrically activated.

5. A device as set forth in claim 4 and including:

(a) socket switch means connecting said case socket to said case connector means, said socket switch means including a socket switch operator positioned in said case socket which is engaged and close circuited by a lamp bulb received in said case socket to complete a circuit path from said case connector means to said case socket, said socket switch means otherwise being open circuited.

6. A device as set forth in claim 3 and including:

(a) a rechargeable battery connected to said alarm circuit means and providing electrical power thereto; and (b) battery charger circuit means connected between said case connector means and said battery and receiving electrical power from said structure connector means through said case connector means and providing electrical power to said battery to recharge same whereby said alarm circuit means receives electrical power indirectly from said structure connector means.

7. A device as set forth in claim 1 wherein:

(a) said structure includes a threaded lamp socket which is electrically activatable;

(b) said mounting means includes a threaded bulb base which is threadedly receivable in said lamp socket whereby said case is mounted to said structure by engaging said bulb base with said lamp socket; and (c) said bulb base has said alarm circuit means connected thereto whereby said alarm circuit means receives power from said lamp socket through said bulb base when said bulb base is engaged with said lamp socket and said lamp socket is electrically activated.

8. A device as set forth in claim 7 and including:

(a) a threaded case socket positioned on said case and adapted to receive a lamp bulb therein; and (b) said case socket being connected to said bulb base whereby a lamp bulb received in said case socket receives power from said lamp socket through said bulb base when said bulb base is received in said lamp socket and said lamp socket is electrically activated.

9. A device as set forth in claim 8 and including:

(a) socket switch means connecting said case socket to said bulb base, said socket switch means including a socket switch operator positioned in said case socket which is engaged and close circuited by a lamp bulb received in said case socket to complete a circuit path from said bulb base to said case socket, said socket switch means otherwise being open circuited.

10. A device as set forth in claim 1 wherein:

(a) said structure comprises can light fixture means; and (b) said case has peripheral dimensions such that said case fits within said can light fixture means.

11.. A thermal emergency detector device comprising:

(a) thermal emergency sensor means operative to sense a thermal emergency condition and providing a condition signal upon sensing said condition;

(b) trigger means having said sensor means connected thereto and providing a trigger signal upon receiving said condition signal;

(c) alarm sounder means connected to said trigger circuit means and being activated to emit an alarm sound signal upon receiving said trigger signal;

(d) a case having said sensor means, said trigger means, and said sounder means positioned therein, said case including case mounting means adapted to enable removably mounting said case to a structure;

(e) case removal switch means capable of a mounted switch state when said case is mounted to said structure and a complementary removed switch state when said case is removed from said structure; and (f) said removal switch means being connected to said trigger means and providing said condition signal thereto upon said switch means assuming said unmounted switch state to thereby cause said trigger means to provide said trigger signal to thereby activate said sounder means upon said case being removed from said structure.

12. A device as set forth in claim 11 wherein said removal switch means includes:

(a) a case removal switch operator mounted in said case and causing said removal switch means to assume said mounted switch state when said operator engages said structure and said removed switch state when said operator is out of engagement with said structure.

13. A device as set forth in claim 11 wherein:

(a) said structure includes a threaded lamp socket which is electrically activatable;

(b) said mounting means includes a threaded bulb base which is threadedly receivable in said lamp socket whereby said case is mounted to said structure by engaging said bulb base with said lamp socket; and (c) said bulb base has said alarm circuit means connected thereto whereby said alarm circuit means receives power from said lamp socket through said bulb base when said bulb base is engaged with said lamp socket and said lamp socket is electrically activated.

14. A device as set forth in claim 13 and including:

(a) a threaded case socket positioned on said case and adapted to receive a lamp bulb therein; and (b) said case socket being connected to said bulb base whereby a lamp bulb received in said case socket receives power from said lamp socket through said bulb base when said bulb base is received in said lamp socket and said lamp socket is electrically activated.

15. A device as set forth in claim 14 and including:

(a) socket switch means connecting said case socket to said bulb base, said socket switch means including a socket switch operator positioned in said case socket which is engaged and close circuited by a lamp bulb received in said case socket to complete a circuit path from said bulb base to said case socket, said socket switch means otherwise being open circuited.

16. A device as set forth in claim 14 and including:

(a) a rechargeable battery connected to said alarm circuit means and providing electrical power thereto; and (b) battery charger circuit means connected between said case connector means and said battery and receiving electrical power from said lamp socket through said bulb base and providing electrical power to said battery to recharge same whereby said alarm circuit means receives electrical indirectly from said lamp socket.

17. A device as set forth in claim 11 wherein:

(a) said thermal emergency sensor means includes a smoke sensor.

18. A device as set forth in claim 11 wherein:

(a) said thermal emergency sensor means includes a heat sensor.

19. A device as set forth in claim 11 wherein said case removal switch means includes:

(a) a removal switch operator extending through said bulb base, said removal switch means assuming said mounted switch state when said operator engages said lamp socket upon said bulb base being received therein and assuming said removed switch state when said bulb base is out of said lamp socket and said operator is out of engagement with said lamp socket.

20. A thermal emergency detector device comprising:

(a) thermal emergency sensor means operative to sense a thermal emergency condition and providing a condition signal upon sensing said condition;

(b) trigger means having said sensor means connected thereto and providing a trigger signal upon receiving said condition signal;

(c) alarm sounder means connected to said trigger circuit means and being activated to emit an alarm sound signal upon receiving said trigger signal;

(d) a case having said sensor means, said trigger means, and said sounder means positioned therein;

(e) said case including a threaded bulb base formed at one end thereof which is adapted for threaded reception in a threaded lamp socket;

(f) said case including a threaded case socket at an opposite end of said case from said bulb base, said case socket being adapted to threadedly receive a lamp bulb therein;

(g) socket switch means connecting said case socket to said bulb base, said socket switch means including a socket switch operator positioned in said case socket which is engaged and close circuited by a lamp bulb received in said case socket to complete a circuit path from said bulb base to said case socket, said socket switch means otherwise being open circuited;

(h) case removal switch means including a removal switch operator extending through said bulb base, said removal switch means assuming a removed switch state when said bulb base is not received in said lamp socket and said operator is out of engagement with said lamp socket and assuming a complementary mounted switch state when said operator engages said lamp socket upon said bulb base being received therein; and (i) said removal switch means being connected to said trigger means and providing said condition signal thereto upon said removal switch means assuming said removed switch state to thereby cause said trigger means to provide said trigger signal to thereby activate said sounder means upon said case being removed from said lamp socket.

21. A device as set forth in claim 28 wherein:

(a) said case has peripheral dimensions such that said case fits within can light fixture means having said threaded lamp socket positioned therein.

* * * * *